US011913763B2

(12) United States Patent
Ball et al.

(10) Patent No.: US 11,913,763 B2
(45) Date of Patent: Feb. 27, 2024

(54) AMMUNITION PRESS AND COMPONENTS THEREOF

(71) Applicant: AOB Products Company, Columbia, MO (US)

(72) Inventors: Shane Ball, Columbia, MO (US); Justin Burke, Columbia, MO (US); Michael Lindsay, Columbia, MO (US); Jarrod Grove, Columbia, MO (US); Michael Cottrell, Ashland, MO (US); James Tayon, Moberly, MO (US); Curtis Smith, Columbia, MO (US)

(73) Assignee: AOB PRODUCTS COMPANY, Columbia, MO (US)

( * ) Notice: Subject to any disclaimer, the term of this patent is extended or adjusted under 35 U.S.C. 154(b) by 217 days.

(21) Appl. No.: 17/445,464

(22) Filed: Aug. 19, 2021

(65) Prior Publication Data

US 2022/0057183 A1 Feb. 24, 2022

Related U.S. Application Data

(60) Provisional application No. 63/067,355, filed on Aug. 19, 2020.

(51) Int. Cl.
*F42B 33/04* (2006.01)
*F42B 33/10* (2006.01)
*F42B 33/00* (2006.01)

(52) U.S. Cl.
CPC ..... *F42B 33/04* (2013.01); *F42B 33/10* (2013.01); *F42B 33/001* (2013.01)

(58) Field of Classification Search
CPC ..... F42B 33/00; F42B 33/001; F42B 33/002; F42B 33/04; F42B 33/10
USPC ..... 86/36, 37
See application file for complete search history.

(56) References Cited

U.S. PATENT DOCUMENTS

| | | | |
|---|---|---|---|
| 1,864,880 | A | 6/1932 | Zimmerman |
| 1,978,130 | A | 10/1934 | Gairing |
| 2,680,988 | A | 6/1954 | Watson |
| 2,800,830 | A | 7/1957 | Gerstenberger |
| 3,025,743 | A | 3/1962 | Cecchi |

(Continued)

FOREIGN PATENT DOCUMENTS

DE 40 08 382 A1 9/1991

OTHER PUBLICATIONS

Amazon.com: KMS Squared UFO 550 Reloading Press Light—Kit: Sports & Outdoors, Aug. 16, 2021, 7 pages.

*Primary Examiner* — James S Bergin
(74) *Attorney, Agent, or Firm* — Stinson LLP

(57) ABSTRACT

An ammunition press for manufacturing or reloading ammunition cartridges. The ammunition press includes a slide bearing about which the ram of the ammunition press moves to provide smooth operation of the ammunition press. A configurable spent primer system is provided to enable a user to select how they want to collect spent primers or other debris from the ammunition press. According to a user's preference, the ammunition press can also be customized to provide a cam-over or non-cam-over sensation as the user operates the ammunition press. A light is integrated with the ammunition press for illuminating a shell holder that holds the ammunition shells (sometimes called cases). Components of the ammunition press and associated methods are also disclosed.

21 Claims, 17 Drawing Sheets

(56) References Cited

U.S. PATENT DOCUMENTS

| | | | | |
|---|---|---|---|---|
| 3,054,322 | A | 9/1962 | Corcoran | |
| 3,107,575 | A | 10/1963 | Paul | |
| 3,157,086 | A | 11/1964 | Bachhuber | |
| 3,175,456 | A | 3/1965 | Goodsell | |
| 3,242,790 | A | 3/1966 | Bachhuber | |
| 3,313,201 | A * | 4/1967 | Lawrence | F42B 33/04 86/32 |
| 3,319,511 | A | 5/1967 | McLean | |
| 3,345,903 | A | 10/1967 | Purdie | |
| 3,349,663 | A | 10/1967 | Slee | |
| 3,603,199 | A | 9/1971 | Corcoran | |
| 3,818,563 | A | 6/1974 | Beaulieu | |
| 3,916,758 | A | 11/1975 | Ashbrook | |
| 4,020,737 | A | 5/1977 | Ranson | |
| 4,078,472 | A | 3/1978 | Simpson | |
| 4,202,245 | A | 5/1980 | McSpadden | |
| 4,393,744 | A | 7/1983 | Lee | |
| 4,418,606 | A | 12/1983 | Lee | |
| 4,425,833 | A | 1/1984 | Purdie | |
| 4,512,235 | A | 4/1985 | Lee et al. | |
| 4,515,063 | A | 5/1985 | Lee | |
| 4,522,102 | A | 6/1985 | Pickens | |
| 4,615,255 | A | 10/1986 | Carter | |
| 4,620,472 | A | 11/1986 | Dillon | |
| 4,637,291 | A | 1/1987 | Alexander | |
| 4,766,798 | A | 8/1988 | David et al. | |
| 4,817,491 | A | 4/1989 | Fenton | |
| 4,890,534 | A | 1/1990 | Bender | |
| 5,221,806 | A | 6/1993 | Chaney et al. | |
| 5,313,869 | A | 5/1994 | Lee | |
| 5,394,785 | A | 3/1995 | Wood | |
| 5,693,905 | A * | 12/1997 | Blodgett | F42B 33/04 86/32 |
| 5,837,916 | A | 11/1998 | Noakes, Jr. | |
| 5,932,828 | A | 8/1999 | Hornady et al. | |
| 6,484,916 | B1 | 11/2002 | Salom et al. | |
| 7,650,825 | B1 | 1/2010 | Lee et al. | |
| 8,234,963 | B2 | 8/2012 | Lee | |
| 9,127,919 | B2 | 9/2015 | Holland | |
| 9,267,775 | B1 | 2/2016 | Kleinschmit | |
| 9,644,931 | B1 * | 5/2017 | Cauley, Jr. | F42B 33/04 |
| 9,846,018 | B1 | 12/2017 | Schloer | |
| 10,076,781 | B1 | 9/2018 | Lee | |
| 10,900,762 | B2 * | 1/2021 | Kinney | F42B 33/001 |
| 11,274,909 | B2 * | 3/2022 | Kinney | F42B 33/10 |
| 2004/0025677 | A1 | 2/2004 | Koch et al. | |
| 2006/0180011 | A1 | 8/2006 | Benn | |
| 2006/0180012 | A1 | 8/2006 | Benn | |
| 2009/0229338 | A1 | 9/2009 | Von Lengeling | |

* cited by examiner

AMMUNITION PRESS AND COMPONENTS THEREOF

CROSS-REFERENCE TO RELATED APPLICATION

This application claims priority to U.S. Provisional Application No. 63/067,355, filed Aug. 19, 2020, the entirety of which is hereby incorporated by reference.

FIELD

The present disclosure generally relates to ammunition accessories, and more particularly to a press for manufacturing or reloading ammunition and components of such a press.

BACKGROUND

When loading or reloading ammunition, an ammunition press is commonly used to perform various operations. Ammunition presses can have various configurations. In many instances, a die is mounted on the press, and a lever actuated ram having a shell holder holding an ammunition shell (sometimes called a case) is used to move the shell into engagement with the die to perform an operation on the shell. For example, the shell may be moved into a sizing or resizing die to size the shell to desired dimensions. As another example, the shell may be moved into engagement with a decapping die for pushing a spent primer out of the shell.

SUMMARY

In one aspect, an ammunition press comprises a frame having a base. The base is configured to engage a support surface to support the ammunition press on the support surface. A die holder is supported by the frame and is configured to hold a die for performing an operation on an ammunition case. A driver is supported by the frame and is movable with respect to the frame to engage an ammunition case with the die. The driver includes a ram, a linkage, and a lever. The ram is movable between a home position and a pressing position for engaging the ammunition case with a die on the die holder. The lever is pivotable with respect to the frame in an actuating direction from a non-actuated position to an actuated position in which the lever is prevented from pivoting farther in the actuating direction. The linkage is connected to the lever such that pivoting of the lever in the actuating direction toward the actuated position moves the ram toward the pressing position. A stop is arranged to engage the driver to set the actuated position of the lever. The stop is adjustable to change the actuated position of the lever in which the lever is prevented from pivoting farther in the actuating direction.

In another aspect, an ammunition press comprises a frame having a base. The base is configured to engage a support surface to support the ammunition press on the support surface. The base includes a slide bearing. A die holder is supported by the frame and is configured to hold a die for performing an operation on an ammunition case. A ram is supported by the frame and is movably disposed in the slide bearing. The ram is movable along a ram axis toward the die holder to move an ammunition case toward the die.

In yet another aspect, an ammunition press comprises a base configured to engage a support surface to support the ammunition press on the support surface. A die holder is supported by the base and is configured to hold a die for ejecting a spent primer from an ammunition case. A ram is supported by the base and is movable toward the die holder to move an ammunition case toward the die holder. The ram includes a coupler. A spent primer fitting is configured to be releasably coupled to the coupler of the ram. The ram includes a spent primer passageway arranged to permit the spent primer to fall into the spent primer fitting from the ammunition case.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
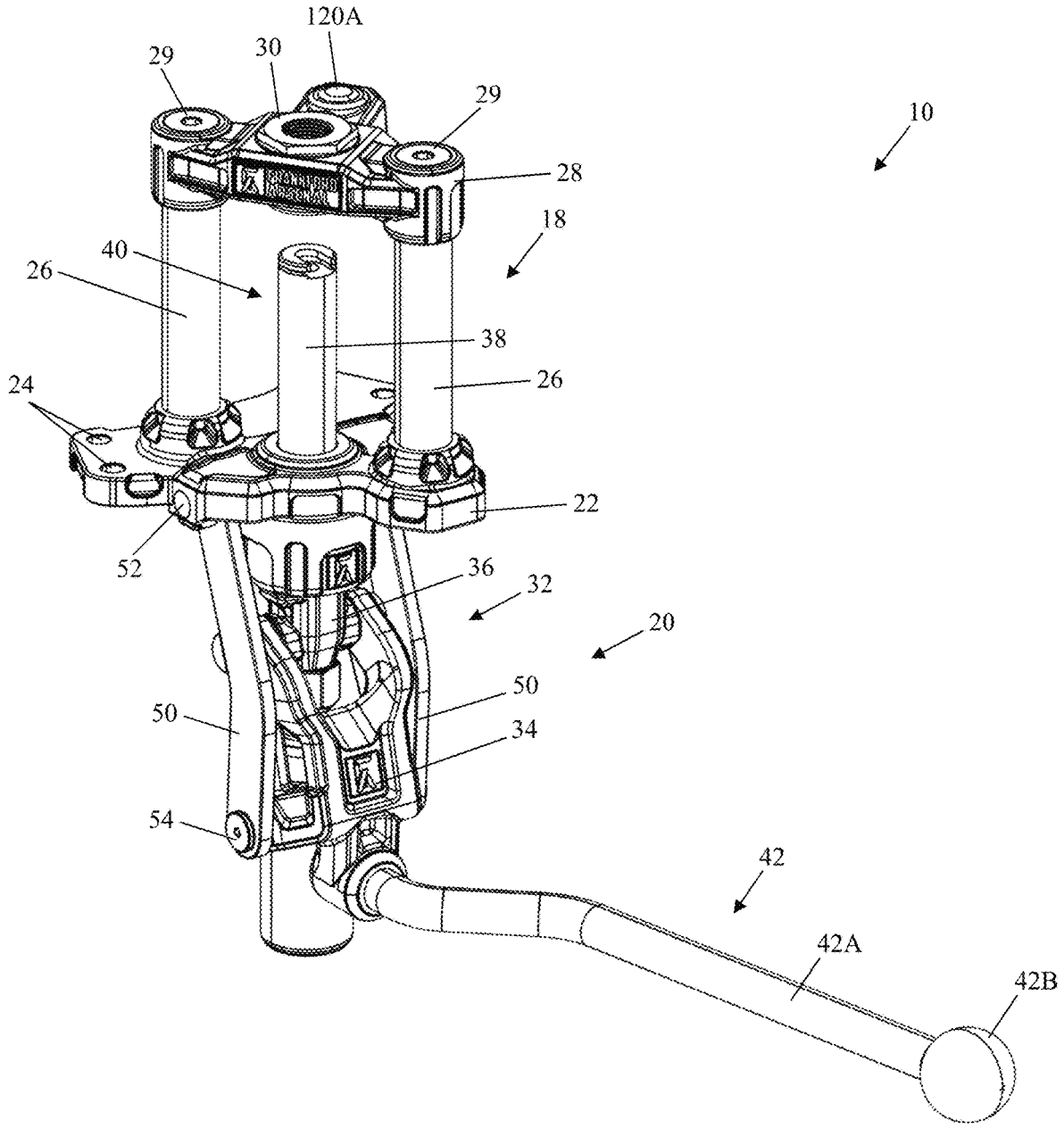
FIG. 1 is a left perspective of an ammunition press according to one embodiment of the present disclosure, the ammunition press shown in an actuated configuration.
Figure 2:
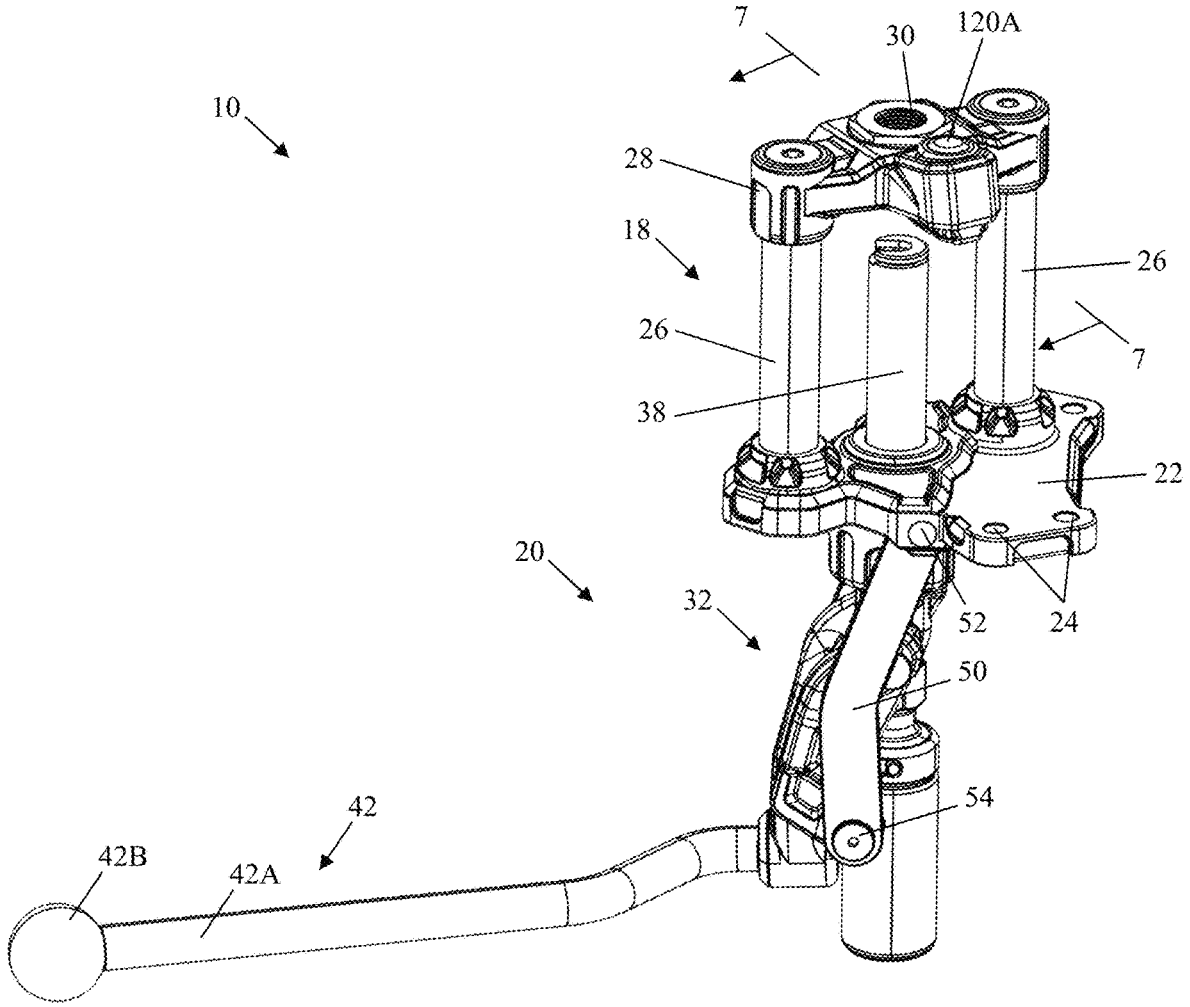
FIG. 2 is a right perspective of the ammunition press of FIG. 1.
Figure 3:
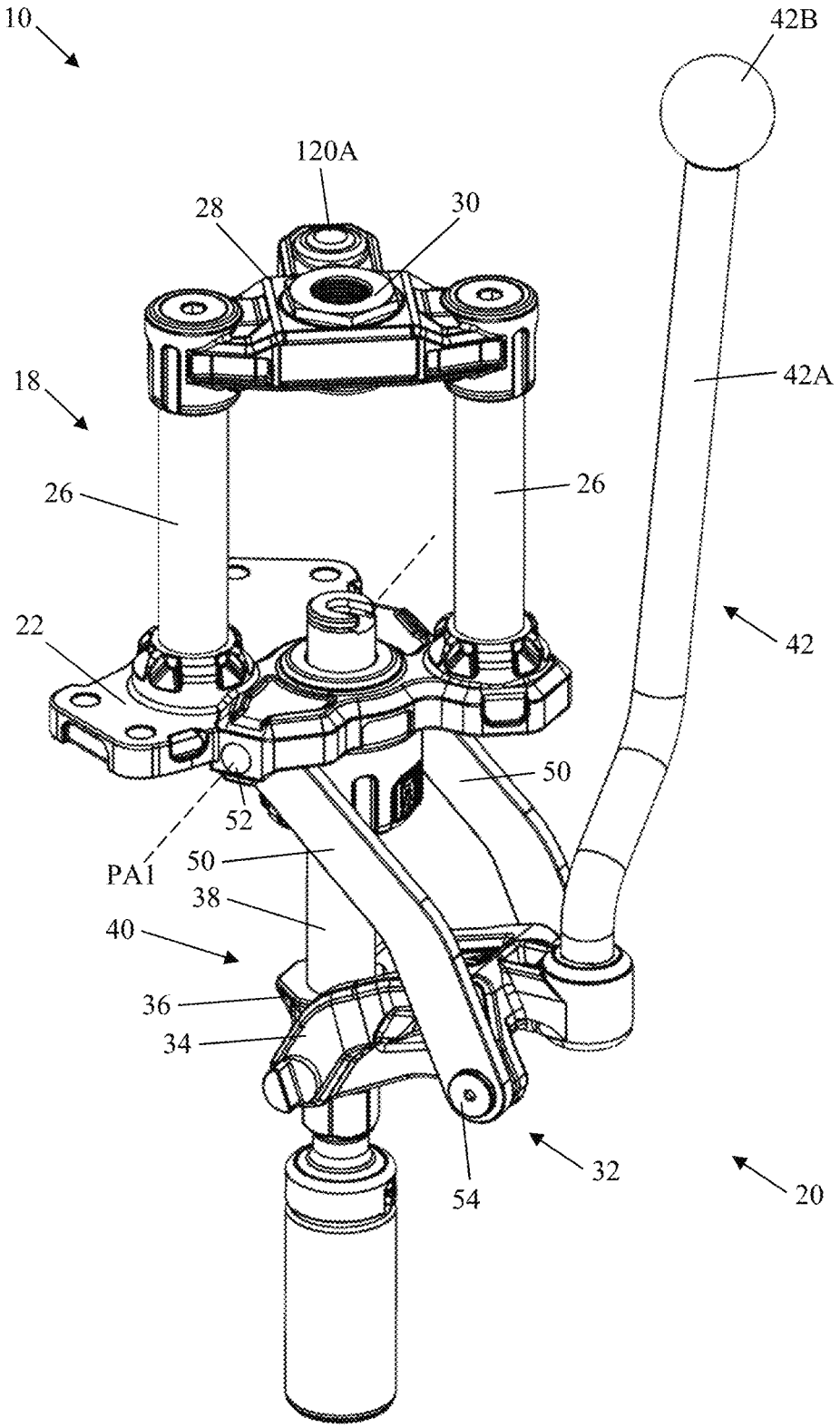
FIG. 3 is a perspective of the ammunition press in a non-actuated configuration.
Figure 4:
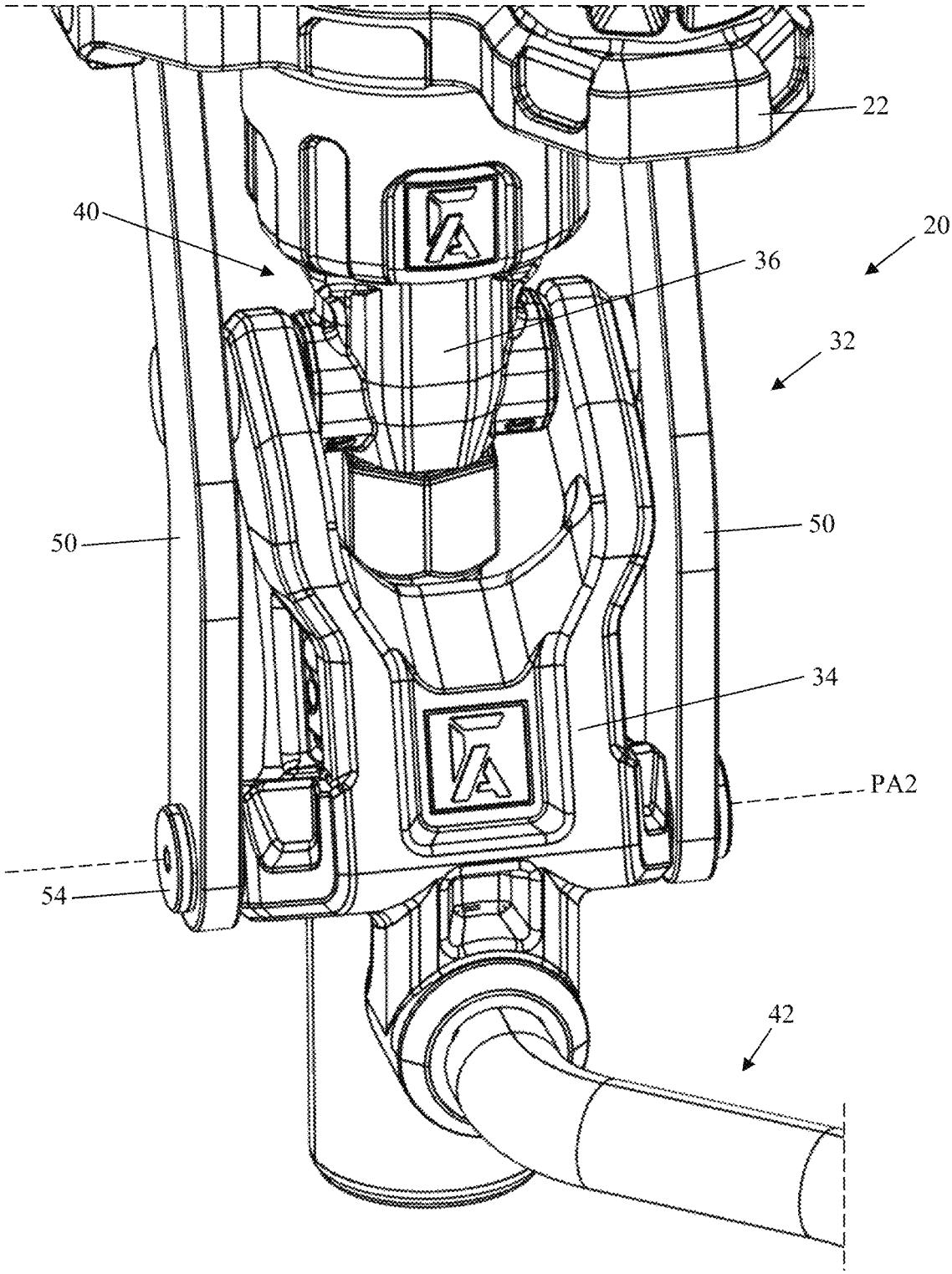
FIG. 4 is an enlarged, fragmentary front perspective of the ammunition press in the actuated configuration.

Referring to FIGS. 1-3, an ammunition or reloading press according to one embodiment of the present disclosure is indicated generally by 10. The ammunition press 10 can be used to perform various operations on an ammunition case (also known as an ammunition shell or casing). The ammunition press 10 is believed to include several improvements over prior ammunition presses. As will be explained in further detail below, the ammunition press 10 includes a slide bearing for smooth operation of the ammunition press, a configurable spent primer catch system for collecting spent primers ejected from ammunition cases, and a cam-over adjustment for changing whether the user feels a "cam-over" sensation or not when the ammunition press is fully actuated.

The ammunition press 10 includes a frame 18 and a driver 20 (e.g., an ammunition case drive assembly). The frame 18 supports the driver 20. In use, the frame 18 remains generally stationary, and the driver 20 moves with respect to the frame for moving the case toward a stationary die (not shown).

The frame 18 includes a base 22 configured to engage a support surface to support the ammunition press 10. The base 22 has a bottom surface adapted for engaging a table top or a bench top for supporting the ammunition press 10 on the support surface. Four openings 24 are provided in the base 22 for bolting the base to the table top, bench top, or other support. The frame 18 further includes two columns 26 extending upward from the base 22 and a head 28 mounted on the upper ends of the columns. The columns 26 are cylindrical shafts connected to the base 22 and head 28 with fasteners 29 (e.g., bolts, screws). In other embodiments, the base, columns and head may be an integral, one-piece component.

The ammunition press 10 includes a die holder 30 for holding various types of dies. For example, a sizing die (not shown) configured to shape a neck of the ammunition case can be supported by the die holder 30. The sizing die can include a pin configured to eject a spent primer from the ammunition case. The die holder 30 is supported by the frame 18 and is configured to hold a die for performing an operation on the ammunition case. The die holder 30 comprises a threaded opening and is threadable onto the die. The die holder 30 includes exterior threads that thread into internal threads of the head 28. The die holder 30 is usually threaded onto the die apart from the ammunition press 10, and then the die holder on the die is threaded into the head 28 of the frame 18, which holds the die in position so ammunition cases can be moved by the ammunition press into engagement with the die. It will be appreciated that other frames and other die holders can be used without departing from the scope of the present disclosure.

Referring to FIGS. 1-6, the driver 20 includes a ram 40, a lever 42, and a linkage 32 operatively connecting the lever to the ram. The lever 42 is pivotable to move the ram 40 toward the die holder 30 to engage an ammunition case with the die held by the die holder. The ram 40 includes a ram base 36 and a ram shaft 38 extending upward from the ram base. The linkage 32 includes a yoke 34 pivotably connected to opposite sides of the ram base 36 by a pin 44. The lever 42 includes an arm 42A connected to and extending away from the yoke 34 and a knob 42B connected to a distal end of the arm. The lever 42 is shown in a non-actuated position in FIG. 3 and in an actuated position in FIGS. 1 and 2. In the illustrated embodiment, the lever 42 is pivotable in an actuating direction by pulling the lever downward from the non-actuated position to the actuated position. As explained in further detail below, in the actuated position, the lever 42 is prevented from pivoting further in the actuating direction, and the ammunition press 10 is adjustable to change the actuated position where further pivoting of the lever is prevented. It will be appreciated that the driver (e.g., lever, linkage, ram) could be configured to move the die toward a stationary case holder without departing from the scope of the present disclosure.

The linkage 32 also includes left and right linkage arms or links 50. The left and right linkage arms 50 have upper end portions pivotably (e.g., rotatably) connected to the base 22 of the frame 18 by pins 52. The linkage arms 50 have lower end portions pivotably connected to the yoke 34 by pins 54. The linkage arms 50 and yoke 34 convert the pivoting movement of the lever 42 to linear travel of the ram 40 toward and away from the die holder 30. As shown in FIGS. 3, 4, 12 and 13, the linkage arms 50 each include a link axis LA extending between pivot axes PA1, PA2 defined by the respective pin connections (e.g., pins 52, 54) at each end of the linkage arms. For reasons which will become apparent, the linkage arms 50 bend between the upper and lower end portions of the links, rather than extend in a straight line between the upper and lower end portions.

The ram 40 includes a case holder 64 at the upper end of the ram shaft 38. The case holder 64 is configured to receive, support and hold a case so that the case moves with the ram 40. The ram 40 is movable by the lever 42 between a home position shown in FIG. 3 and a "pressing" position shown in FIG. 1. The linkage 32 is connected to the lever 42 such that pivoting of the lever in the actuating direction toward the actuated position moves the ram 40 toward the pressing position. Likewise, pivoting the lever 42 in the direction opposite the actuating direction (e.g., a non-actuating direction) toward the non-actuated position moves the ram 40 toward the home position. It will be understood that the ram 40 is moved toward the pressing position to press an ammunition case against a die on the die holder 30. In use, an ammunition case is supported on the ram 40, the ram is moved toward the pressing position to engage the case with the die, and then the ram is moved back to the home position. The ammunition case is removed from the ram 40 and the process is repeated with another ammunition case. The ram 40 is repeatedly moved between the home and pressing positions to press several ammunition cases against the die.

Referring to FIGS. 1-3 and 6-9, the ram 40 is supported by the base 22 of the frame 18. The base 22 of the frame 18 includes a slide bearing 56. The ram 40 is movably disposed in the slide bearing 56. The slide bearing 56 defines a ram passageway 58, through which the ram 40 (e.g., ram shaft 38) extends. The slide bearing 56 acts as a guide to brace and guide the movement of the ram 40 upward and downward in a linear travel path along a ram axis RA. The ram 40 (e.g., the ram shaft 38) moves along the ram axis RA toward the die holder 30 to move the ammunition case toward the die. The slide bearing 56 makes the pivoting of the lever 42 by a user feel very smooth and controlled and prevents any binding from occurring between the ram 40 and the base 22, enhancing the usability of the ammunition press 10. In the illustrated embodiment, the slide bearing 56 includes a plurality of (broadly, at least two) ball bearings 60 spaced apart along the ram axis RA. The spaced apart ball bearings 60 provide upper and lower support to the ram 40 as the ram slides within the slide bearing 56, preventing the ram from binding or twisting within the slide bearing. The slide bearing 56 includes a plurality of ball bearing tracks 62. A plurality of ball bearings 60 are disposed within or along each ball bearing track 62. Each ball bearing track 62 is a closed loop. Each ball bearing track 62 has a generally oval shape (e.g., stadium or racetrack shape), with two straight segments 62A and two curved segments 62B interconnecting the ends of the straight segments. The straight segments 62A are generally parallel to the ram axis RA. The slide bearing 56 includes enough ball bearings 60 in each ball bearing track 62 to fill up about half the ball bearing track. This allows to the ball bearings 60 to move along (e.g., around) the ball bearing track 62 as the ram 40 slides relative to the slide bearing 56. Other configurations of the slide bearing are within the scope of the present disclosure.

Figure 5:
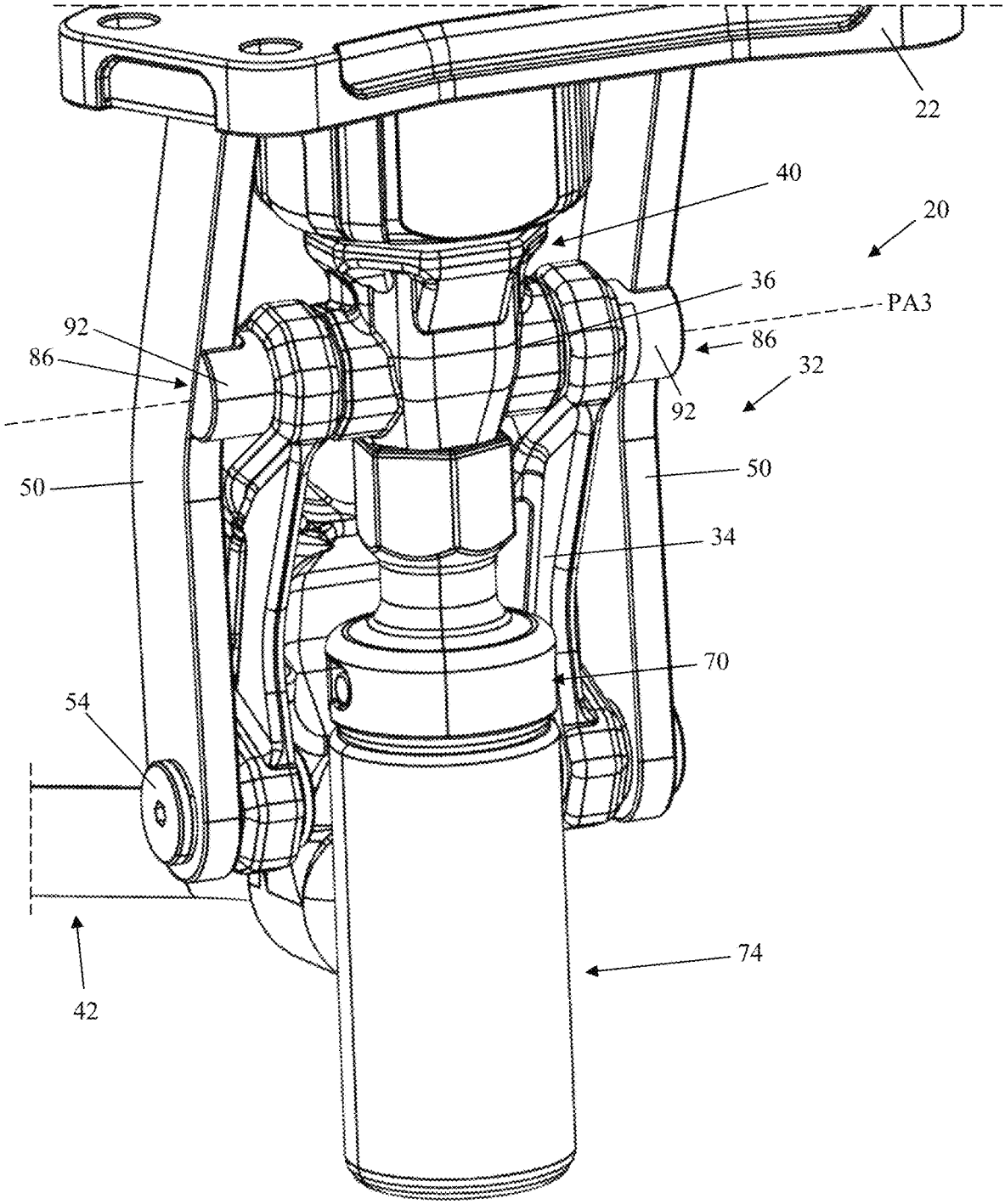
FIG. 5 is an enlarged, fragmentary rear perspective of the ammunition press in the actuated configuration, the ammunition press is shown with a spent primer receptacle.
Figure 10:
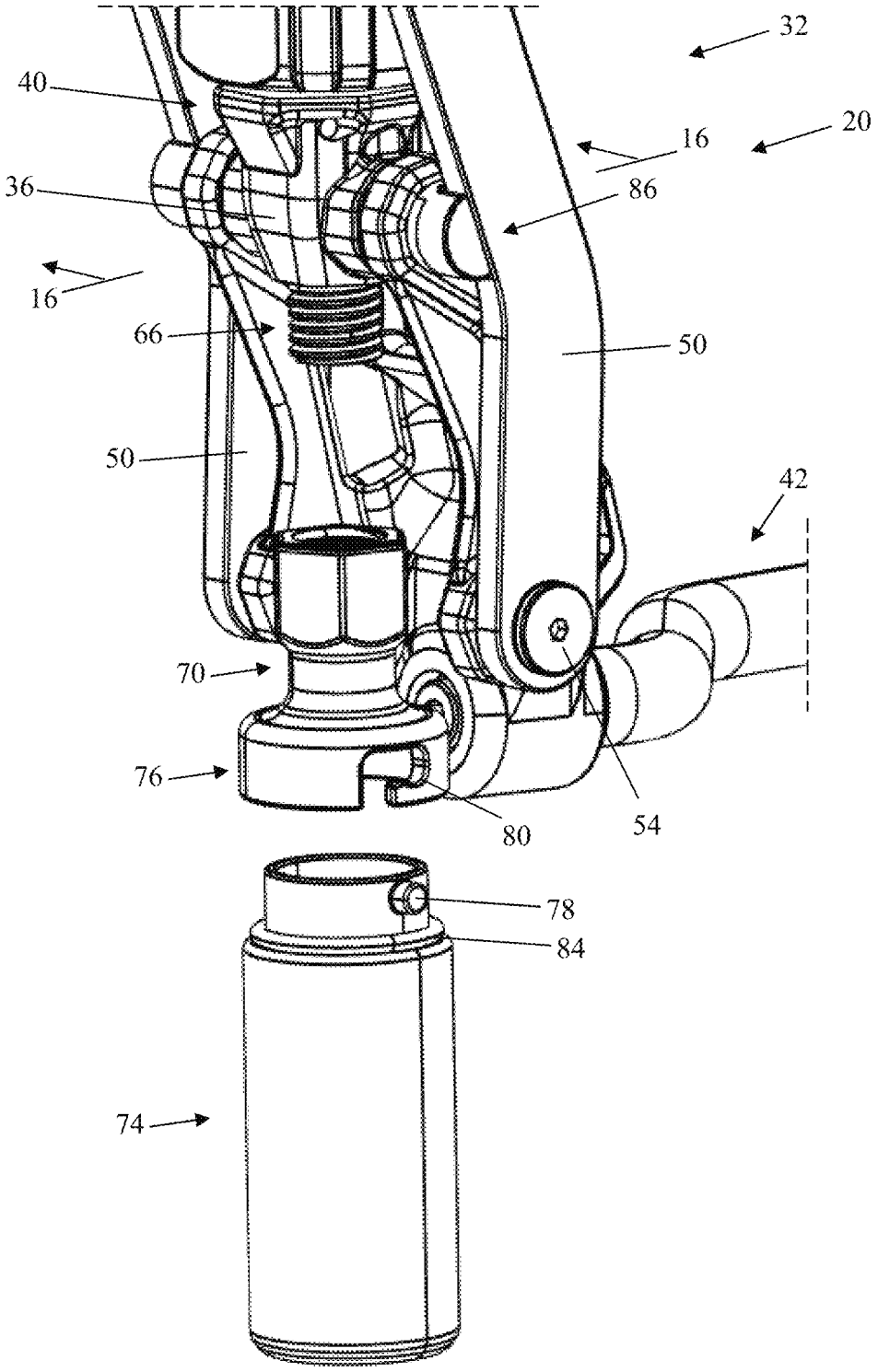
FIG. 10 is an enlarged, fragmentary, partially exploded view of the ammunition press.
Figure 11:
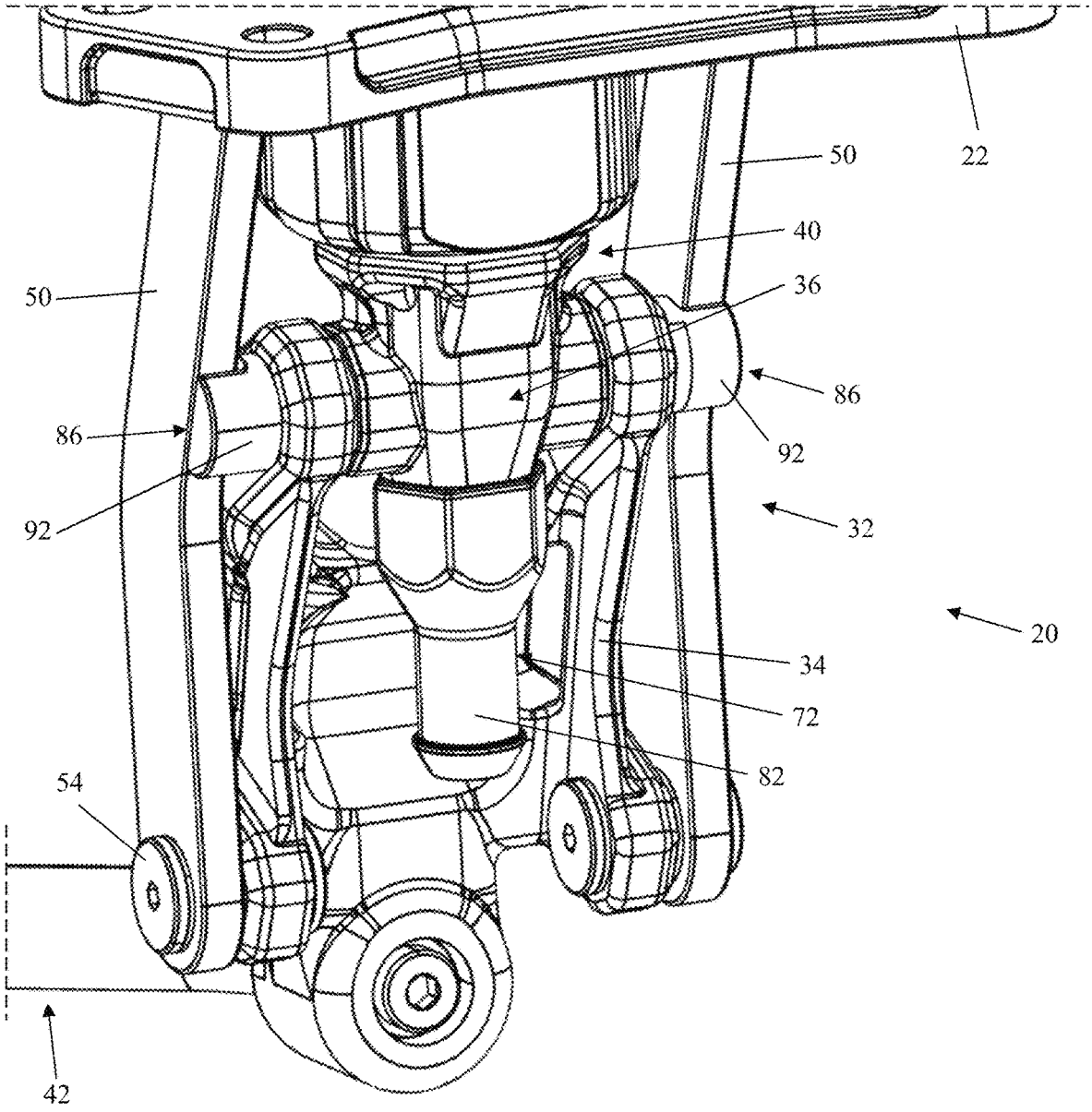
FIG. 11 is an enlarged, fragmentary rear perspective of the ammunition press in the actuated configuration, the ammunition press shown with a hose fitting.

In operation, if a decapping die is held by the die holder 30, a pin will be received in the mouth end of the ammunition case as the ram 40 moves the case toward the die. The case will be moved sufficiently toward the die such that the pin forces the spent primer out of the primer end of the case. Referring to FIGS. 5, 10, and 11, the ammunition press 10 includes a configurable spent primer catch system for collecting spent primers ejected from ammunition cases. The ram 40 includes a coupler 66 (e.g., a spent primer fitting coupler). The coupler 66 is positioned at the lower end of the ram 40. The ammunition press 10 may include one or more spent primer fittings. Each spent primer fitting is configured to releasably couple to the coupler 66 of the ram 40. Accordingly, the spent primer fitting is carried by the ram 40. In the illustrated embodiment, the coupler 66 includes external threads that threadably engage internal threads of the respective spent primer fitting. In another embodiment, the coupler may include internal threads and the spent primer fitting may include external threads. The ram 40 (e.g., ram base 36 and ram shaft 38) includes or defines a spent primer passageway 68. The spent primer passageway 68 extends from the upper end to the lower end of the ram 40 (e.g., through the ram). The spent primer passageway 68 is arranged to receive or permit a spent primer (not shown) to fall into the spent primer fitting from the ammunition case. The spent primer passageway 68 includes an open upper end through which the spent primer falls when the spent prime is dislodged by the die and an open lower end through which the spent primer falls into the spent primer fitting.

In the illustrated embodiment, the ammunition press 10 includes two spent primer fittings, including a first or receptacle spent primer fitting 70 and a second or hose spent primer fitting 72. The receptacle spent primer fitting 70 includes a receptacle connector 76 configured to connect to a spent primer receptacle 74. The spent primer receptacle 74 is removably coupled to the receptacle connector 76 so that the spent primer receptacle can be fully supported by the connector and can be removed from the connector to be emptied. In the illustrated embodiment, the spent primer receptacle 74 includes protrusions 78 (broadly, "retainers") that are received in bayonet slots 80 (broadly, "keepers") to couple the spent primer receptacle to the receptacle spent primer fitting 70. The spent primer receptacle 74 includes two protrusions 78 on opposing sides thereof, and the receptacle connector 76 includes two corresponding bayonet slots 80 on opposing sides thereof. The spent primer receptacle 74 includes a resilient O-ring 84 (broadly, "biaser"). The O-ring 84 is compressed when the spent primer receptacle 74 is coupled to the receptacle spent primer fitting 70 to stabilize the connection therebetween and resist the disconnection (e.g., rotation) of the spent primer receptacle with the spent primer fitting. The O-ring 84 biases the protrusions 78 into valleys of the bayonet slots 80 to resist inadvertent decoupling.

The hose spent primer fitting 72 includes a hose connector 82 configured to connect to a hose or conduit (not shown). The illustrated hose connector 82 includes a barb configured to be inserted into the lumen of the hose to secure the hose to the hose spent primer fitting 72. The hose can lead away from the ammunition press 10, such as to a bucket or trash can for collecting the spent primers. Each spent primer fitting 70, 72 is arranged to permit the spent primer to fall into the respective spent primer receptacle 74 or hose when the spent primer is connected to said respective spent primer receptacle or hose and the spent primer fitting is coupled to the coupler 66 of the ram 40. Each spent primer fitting 70, 72 defines a passageway that aligns with the spent primer passageway 68 of the ram 40 to permit the spent primer to fall into the spent primer receptacle 74 or hose, respectively.

Figure 6:
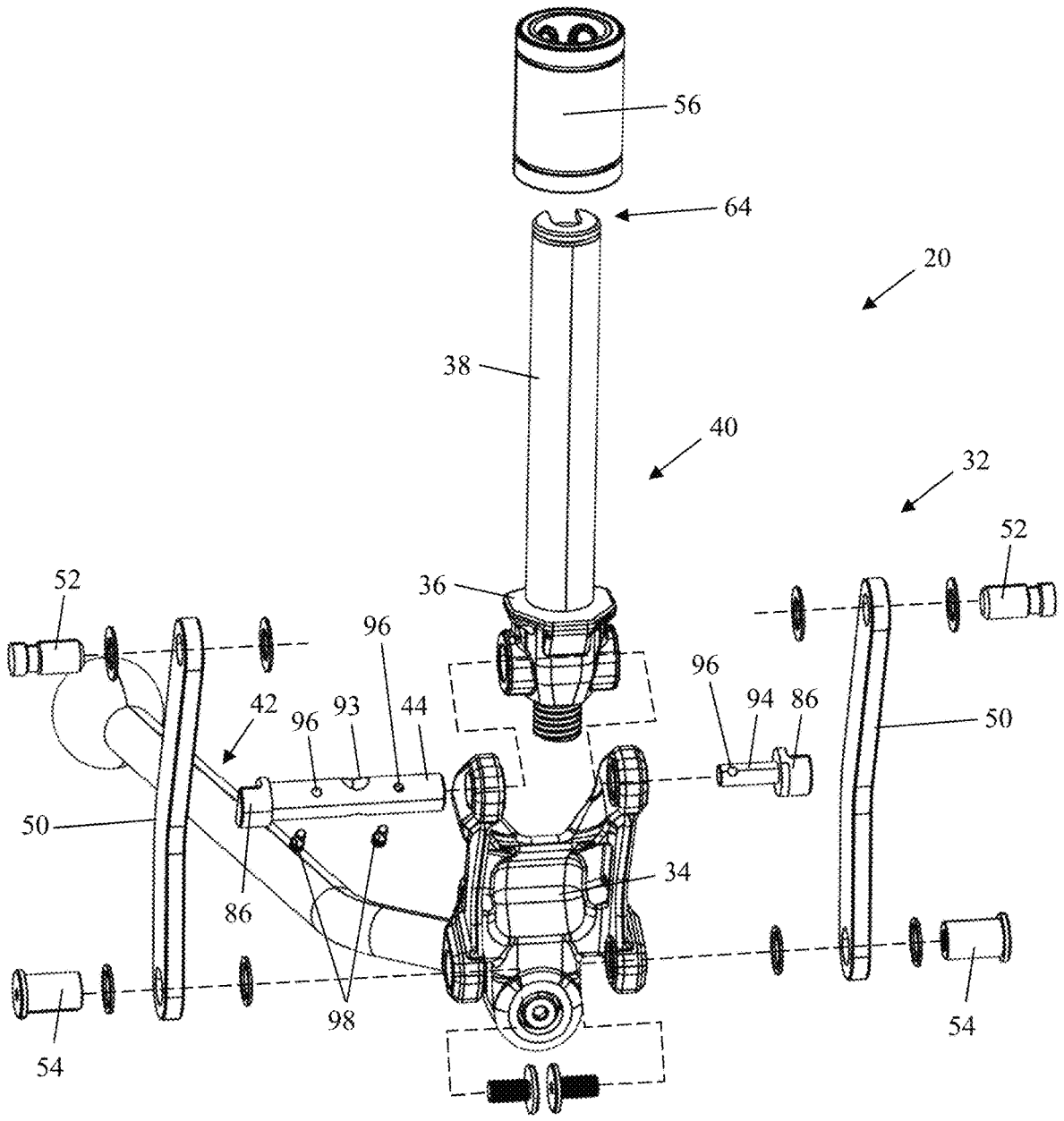
FIG. 6 is an exploded view of a driver of the ammunition press.

Referring to FIGS. 5 and 6, the ammunition press 10 includes at least one stop 86 that sets the lever 42 in the actuated position. In the illustrated embodiment, the ammunition press 10 includes two stops 86 which are generally identical (e.g., mirror images of each other). In the actuated position, the stops 86 prevent the lever 42 from pivoting farther in the actuating direction. The stops 86 are arranged on opposite sides of the yoke 34. Each stop 86 is arranged to engage the driver 20 to set or define the actuated position of the lever 20. In the illustrated embodiment, each stop 86 is arranged to engage the linkage 32 of the driver, or more specifically the linkage arms 50, to set the actuated position of the lever 42. When the linkage arms 50 engage the stops 86, the lever 42 is prevented from pivoting farther in the actuating direction (e.g., downward). The stops 86 are located to engage the middle portion of the linkage arms 50 when the lever 42 is pivoted fully downward.

The stops 86 are adjustable to change the actuated position of the lever 42 in which the lever is prevented from pivoting farther in the actuating direction. In other words, the ammunition press 10 can be configured to have different actuated positions of the lever 42. This adjustability allows the user to configure the ammunition press 10 to provide a "cam-over" sensation or not when the lever 42 is fully actuated and in the actuated position. Some users find it desirable to feel an ammunition press cam over at the actuated position of the lever, and other users prefer the press to not cam over. The adjustability of the ammunition press 10 permits users to select from a cam-over mode and a non-cam-over mode to suit their preference.

Figure 12:
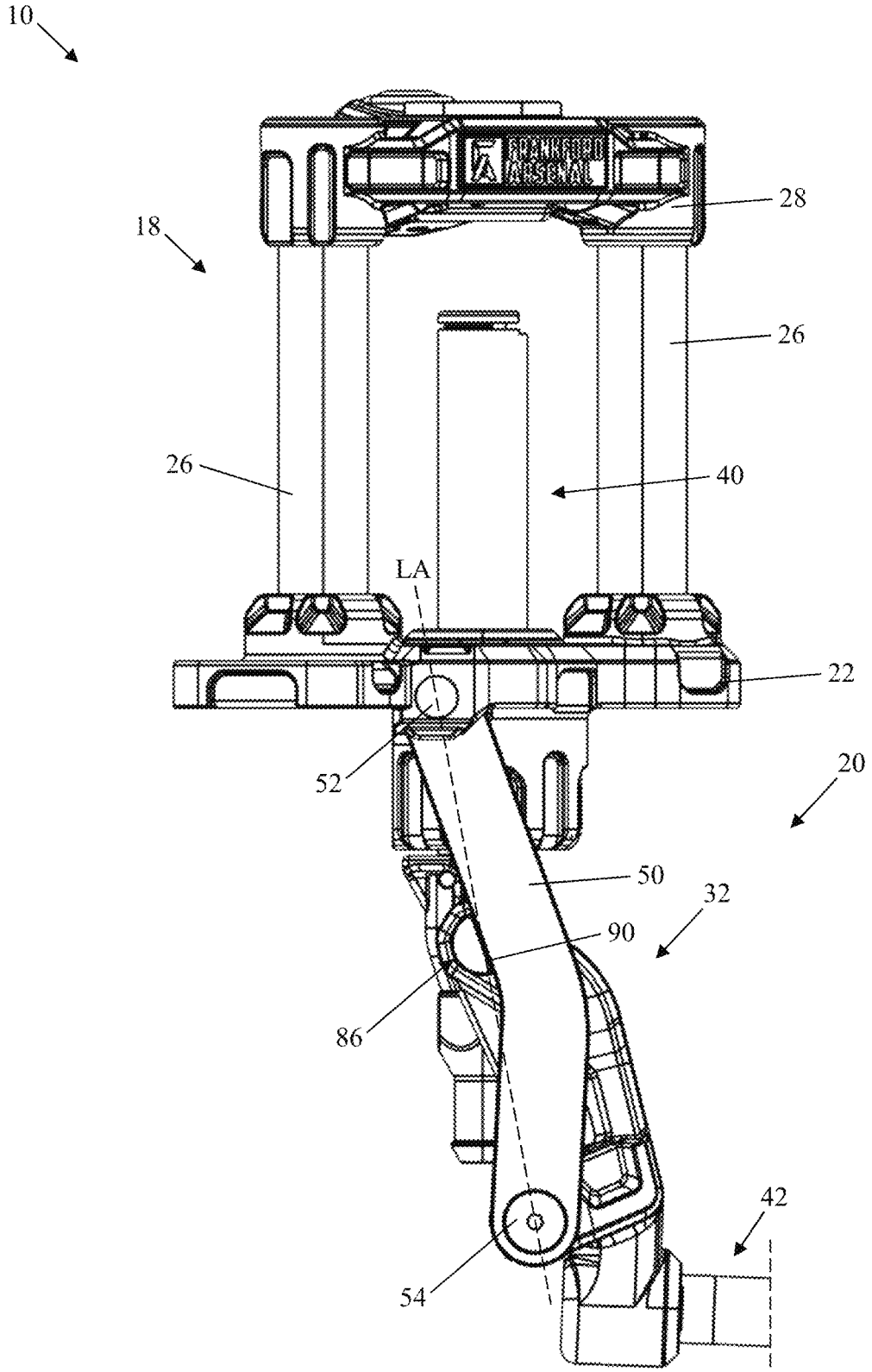
FIG. 12 is a side elevation of the ammunition press in a cam-over actuated configuration.
Figure 13:
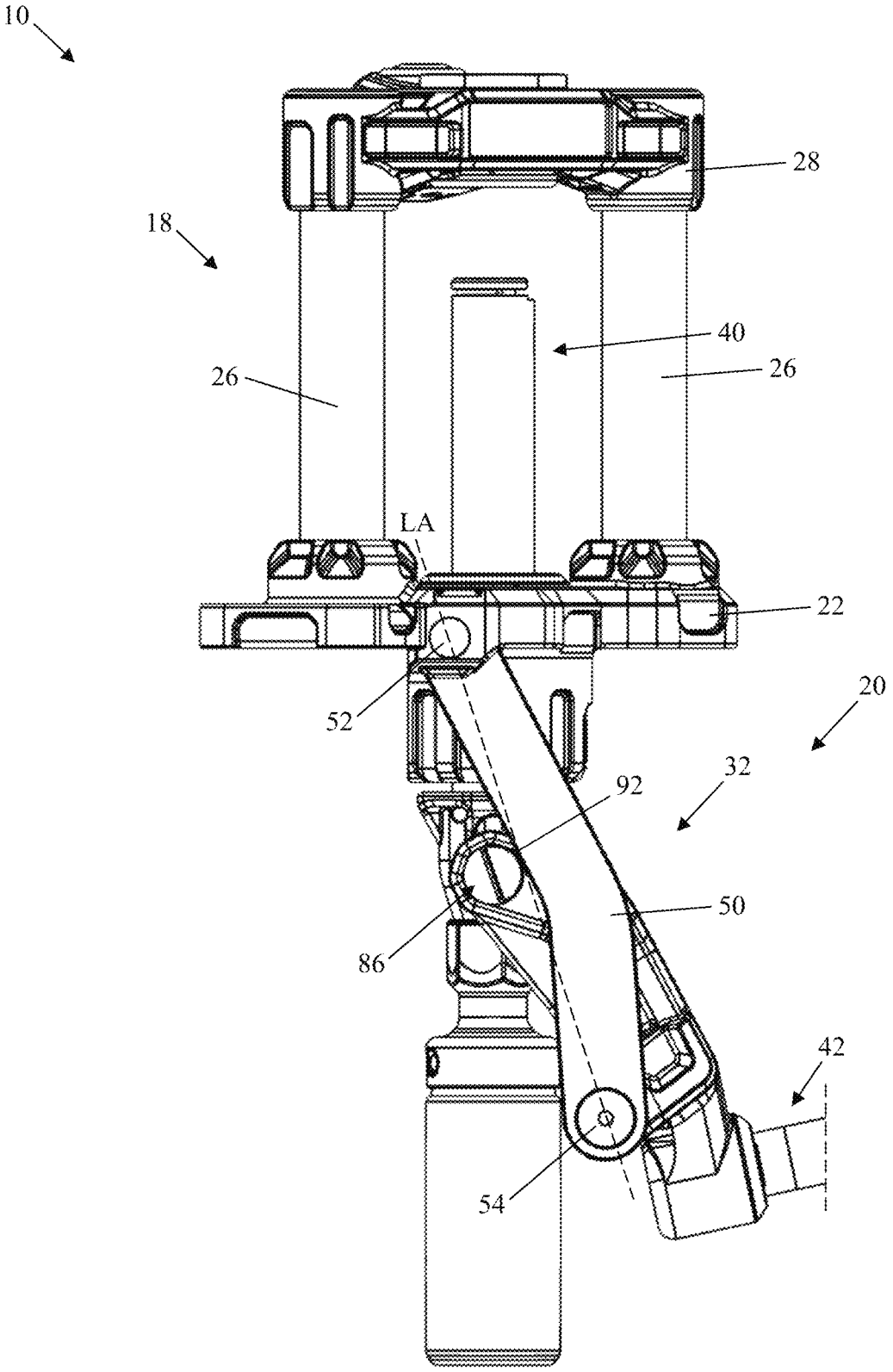
FIG. 13 is a side elevation of the ammunition press in a non-cam-over actuated configuration.
Figure 14:
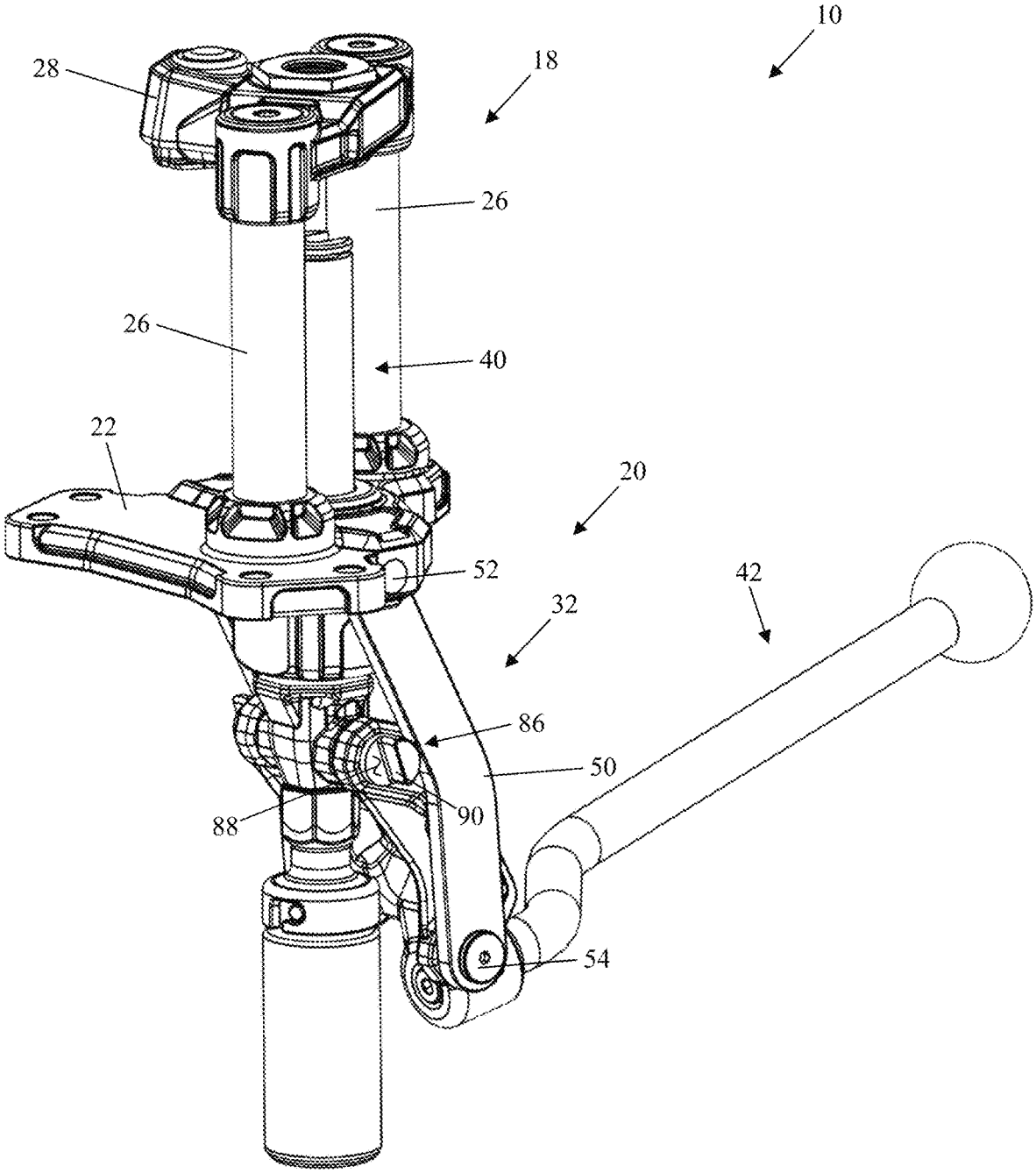
FIG. 14 is a perspective of the ammunition press in the non-cam-over actuated configuration.

The stops 86 are adjustable to change whether the ammunition press 10 cams over or not. Each stop 86 is arrangeable (relative to the driver 20) in a first or cam-over configuration or position and a second or non-cam-over configuration or position. The first configuration is shown in FIGS. 1-5 and 10-12. In the first configuration, each stop 86 is arranged to engage the driver 20 (e.g., one of the linkage arms 50) to set the lever 42 in a first or cam-over actuated position in which the lever is prevented from pivoting farther in the actuating direction. The second configuration is shown in FIGS. 13 and 14. In the second configuration, each stop 86 is arranged to engage the driver 20 (e.g., one of the linkage arms 50) to set the lever 42 in a second or non-cam-over actuated position in which the lever is also prevented from pivoting farther in the actuating direction. As shown in FIGS. 12 and 13, the second actuated position of the lever 42 is different from the first actuated position of the lever. Specifically, the lever 42 is rotated farther in the actuating direction to get to the first actuated position (FIG. 12) than the second actuated position (FIG. 13). This extra movement of the lever 42 to the first actuated position creates the cam-over sensation as described in more detail below.

In the illustrated embodiment, the shape of each stop 86 is configured to permit sufficient travel of the lever 42 to provide the cam-over sensation to the user before the stop contacts the driver 20 when the stop is in the first configuration and to permit insufficient travel of the lever to provide the non-cam-over sensation to the user when the stop is in the second configuration. The cam-over sensation is caused by the ram 40 reaching its maximum upward travel and then moving downward slightly at the end of the stroke of the lever 42. As the user moves the lever 42 toward the actuated position, the user needs to apply pressure to the lever to overcome the resistance of the case against the die. The cam-over sensation provides the user with the feeling of force being released at the end of the lever stroke. The force is released because at the end of the stroke, the ram 40 moves downward slightly as the link axes LA move closer to the vertical. The ram 40 moves slightly downward because after the ram reaches its maximum upward extent, the lower ends of the linkage arms 50 move downward more than the upper end of the yoke 34 correspondingly moves upward as the lever 42 is continued to be pivoted in the actuating direction, thereby lowering the ram. Before the ram 40 reaches its maximum upward extent, the lower ends of the linkage arms 50 move downward less than the upper end of the yoke 34 correspondingly moves upward as the lever 42 is pivoted in the actuating direction, thereby raising the ram. Desirably, the ram 40 reaches its maximum upward extent when the stops 86 are in the second configuration and the lever 42 is in the second actuated position (FIG. 13). For example, the linkage arms 50 (and/or stops 86) may be shaped (e.g., bent) such that the linkage arms engage the stops 86 when the ram 40 reaches its maximum upward extent (and when the stops 86 are in the second configuration and the lever 42 is in the second actuated position). Other configurations can be used without departing from the scope of the present disclosure.

Each stop 86 includes a recess 88 (FIG. 14) sized and shaped to receive the driver 20 (e.g., one of the linkage arms 50). Each stop 86 includes a first or cam-over engagement surface 90 defining the recess 88. The first engagement surface 90 is generally planar. In the first configuration, the recess 88 is arranged to receive (e.g., faces) the driver 20 (e.g., one of the linkage arms 50). In particular, the first engagement surface 90 is configured to engage (e.g., faces) the driver 20 (e.g., one of the linkage arms 50). The recesses 88 allow the linkage arms 50 and the lever 42 to travel farther as the lever 42 is pivoted in the actuating direction than when the stops 86 are in the second configuration to provide the cam-over sensation. Each stop 86 also includes a second or non-cam-over engagement surface 92 opposite the first engagement surface 90. The second engagement surface 92 is arcuate. The second engagement surface 92 is configured to engage (e.g., faces) the driver 20 (e.g., one of the linkage arms 20) when the stop 86 is in the second configuration. Other configurations of the stops can be used without departing from the scope of the present disclosure.

In the illustrated embodiment, the stops 86 are carried by the driver 20. Accordingly, the stops 86 move with the driver 20 with respect to the frame 18 when the lever 42 is moved in the actuating direction to move the ram 40 toward the pressing position. Specifically, the stops 86 are carried by the ram 40. As shown in FIG. 6, one stop 86 is connected to the pin 44 about which the yoke 34 and ram 40 pivot. In particular, the stop 86 is fixed to the pin 44 (e.g., the stop and the pin are an integrally formed, one-piece component), at one end thereof. The other stop 86 is connected to a pin insert 94. In particular, the stop 86 is fixed to the pin insert 94 (e.g., the stop and the pin insert are an integrally formed, one-piece component), at one end thereof. The pin insert 94 is sized and shaped to be inserted into a longitudinal bore of the pin 44. The longitudinal bore extends from the free end of the pin 44 toward the stop 86 fixed to the other end of the pin 44. The pin 44 extends through aligned openings in the yoke 34 and the ram base 36. The pin 44 defines a third pivot axis PA3 (FIG. 5) about which the yoke 34 pivots. The third pivot axis PA3 extends through the stops 86. The pin 44 includes a spent primer opening 93 therethrough that aligns with the spent primer passageway 68 of the ram 40 so that the spent primer can fall through the pin.

Figure 15:
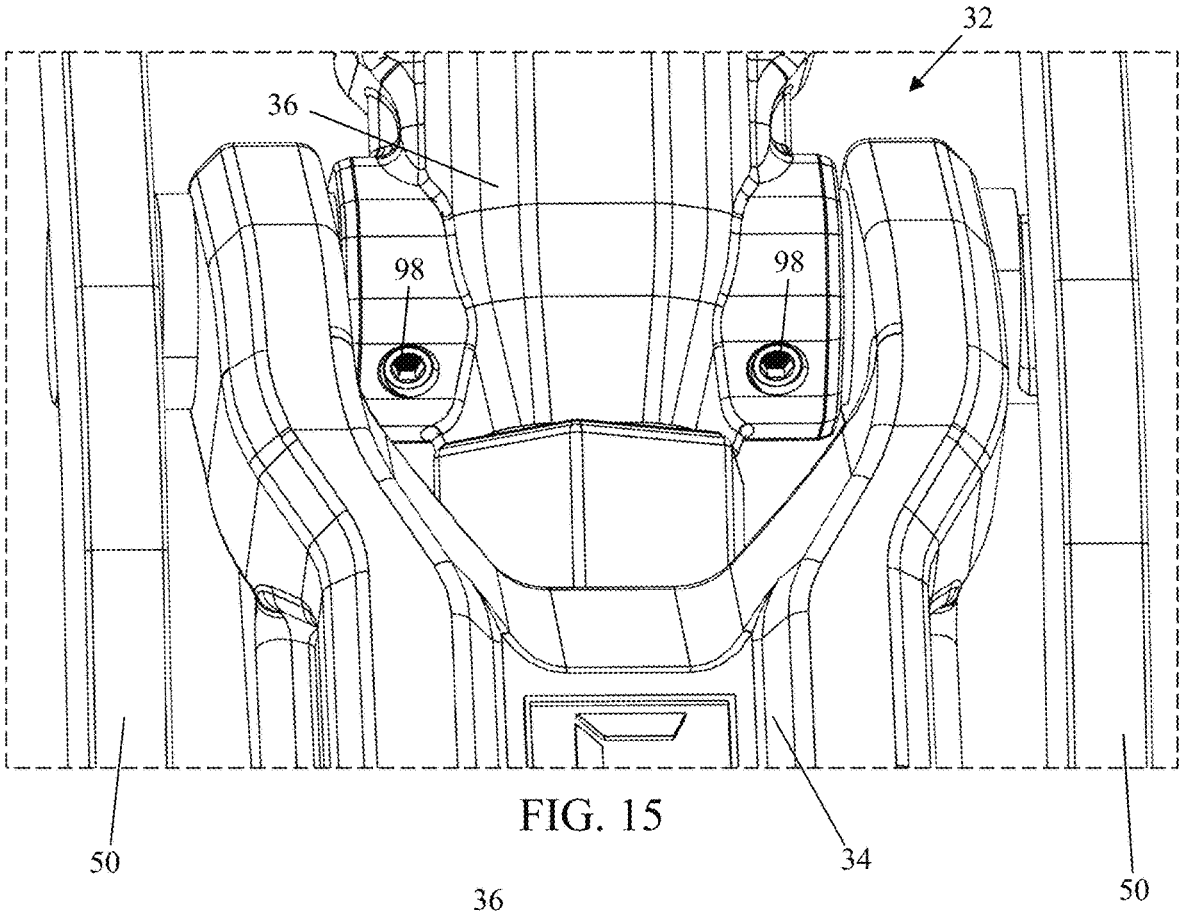
FIG. 15 is an enlarged, fragmentary perspective of the driver of the ammunition press.
Figure 16:
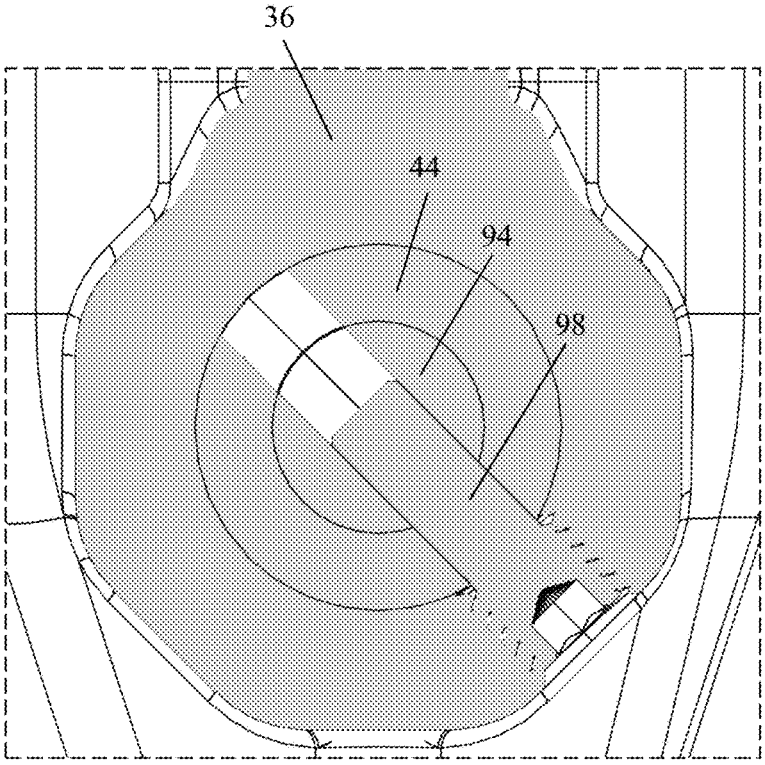
FIG. 16 is an enlarged, fragmentary cross-section of the ammunition press taken through line 16-16 of FIG. 10.

The stops 86 are fixed to the ram 40 in either the first or second configurations. Specifically, the stops 86 do not move relative to the ram base 36 when the stops are in the first or second configurations. The pin 44 includes openings 96 that align with corresponding openings (e.g., internally threaded openings) in the ram base 36 that receive fasteners 98 (e.g., set screws), as shown in FIGS. 15 and 16, for fixing the pin 44 relative to the ram base 36. The pin insert 94 also includes an opening 96 that aligns with one of the openings in the ram base and one of the openings in the pin 44 such that one of the fasteners 98 extending into the ram base and pin also extends into the pin insert for fixing the pin insert to the pin and the ram base 36. In other embodiments, the stops 86 may be carried by other components of the ammunition press 10, such as to a different component of the driver 20 or to the base 22.

To change the configuration of the ammunition press 10 from the cam-over mode to the non-cam-over mode, the stops 86 are moved from the first configuration to the second configuration. Specifically, the stops 86 are rotated between the first and second configurations. In the illustrated embodiment, the stops 86 are rotated about 180 degrees (about the third pivot axis PA3) between the first and second configurations. To rotate the stops 86, the fasteners 98 (FIGS. 15 and 16) are removed from the pin 44 and pin insert 94. This allows the pin 44 and pin insert 94 to rotate relative to the ram base 36. The stops 86 are then rotated about 180 degrees from the first configuration to the second configuration. The fasteners 98 are then reinstalled to secure the stops 86 (e.g., the pin 44 and pin insert 94) to the ram base 36. As shown in FIGS. 13 and 14, the result is that the stops 86 are now positioned such that the second engagement surfaces 92 engage the linkage arms 50 (instead of the first engagement surface 90), and because of the size and shape of the stops, the stops engage the linkage arms earlier in the downward stroke of the lever 42. Accordingly, in the actuated position of the lever 42, force has not been released as in the cam-over mode, and the user does not experience the sensation of camming over. This process is generally repeated to move the stops 86 back to the first configuration. As a result of moving the stops 86 back to the first configuration, the stops are not positioned such that the first engagement surfaces 90 engage the linkage arms 50 and such that the recesses 88 receive the linkage arms. This results in the stops 86 engaging the linkage arms 50 later in the downward stoke of the lever 42. Accordingly, in the actuated position of the lever 42, force has been released such that the user experiences the sensation of camming over. Because the openings 96 extend through the pin 44 and pin insert 94, the openings are aligned with the corresponding openings in the ram base 36 that receive the fasteners 98 regardless of if the stops 86 are in the first or second configurations. Likewise, because the spent primer opening 93 extends through the pin 44, the spent primer opening is aligned with the ram passageway 68 regardless of if the stop 86 is in the first or second configuration.

Figure 7:
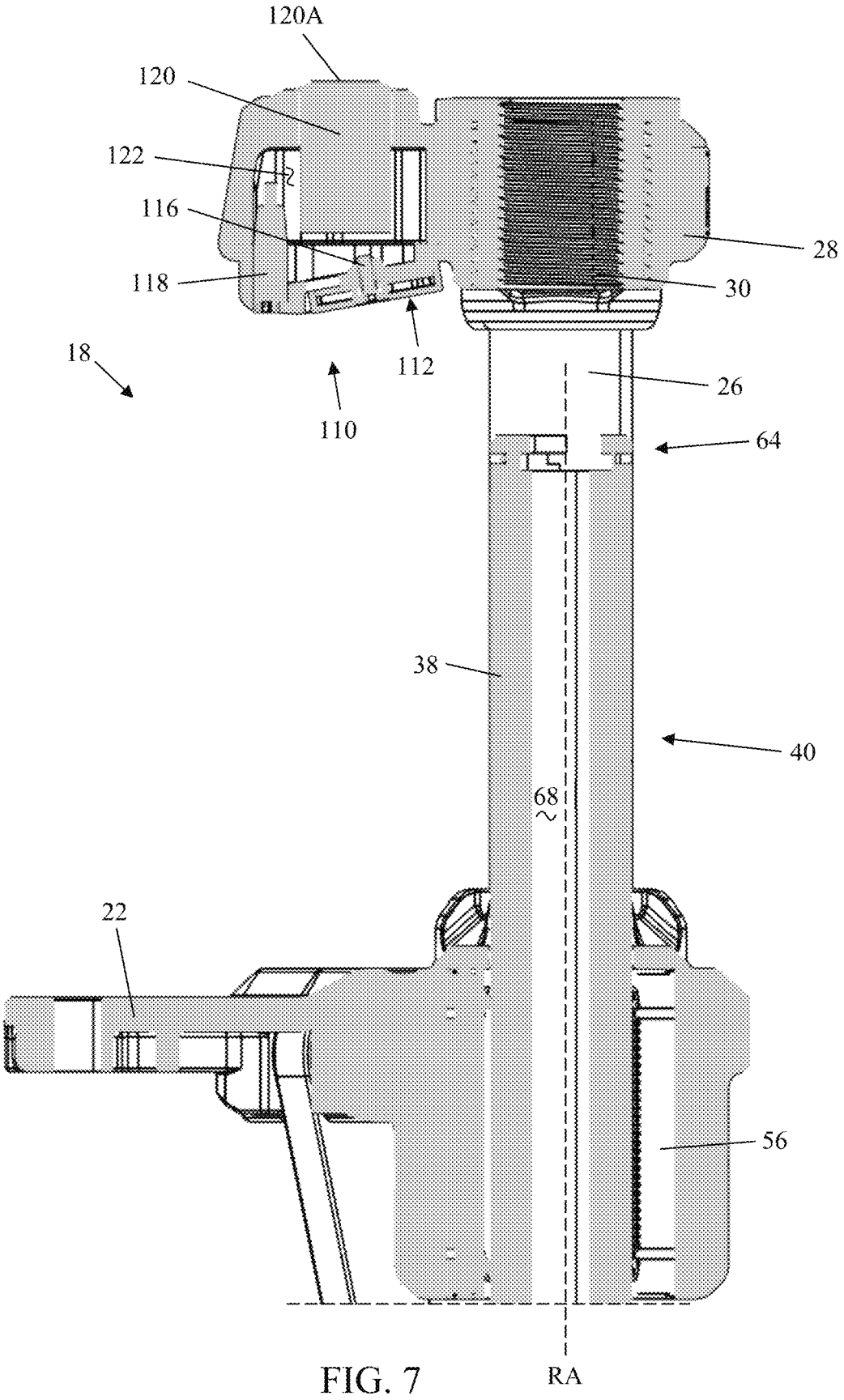
FIG. 7 is an enlarged, fragmentary cross-section of the ammunition press in the actuated configuration taken through line 7-7 of FIG. 2.
Figure 8:
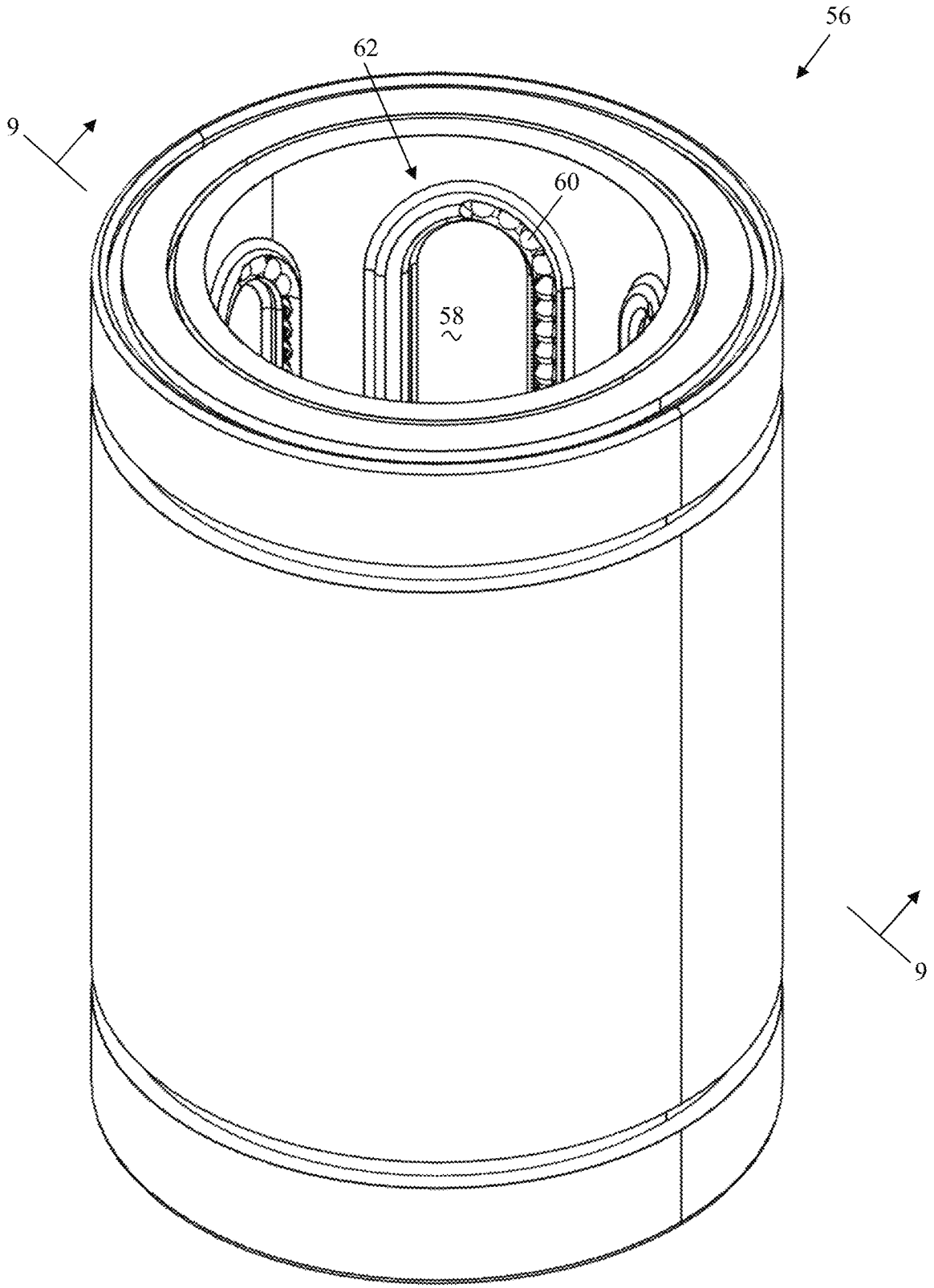
FIG. 8 is a perspective of a slide bearing of the ammunition press.
Figure 9:
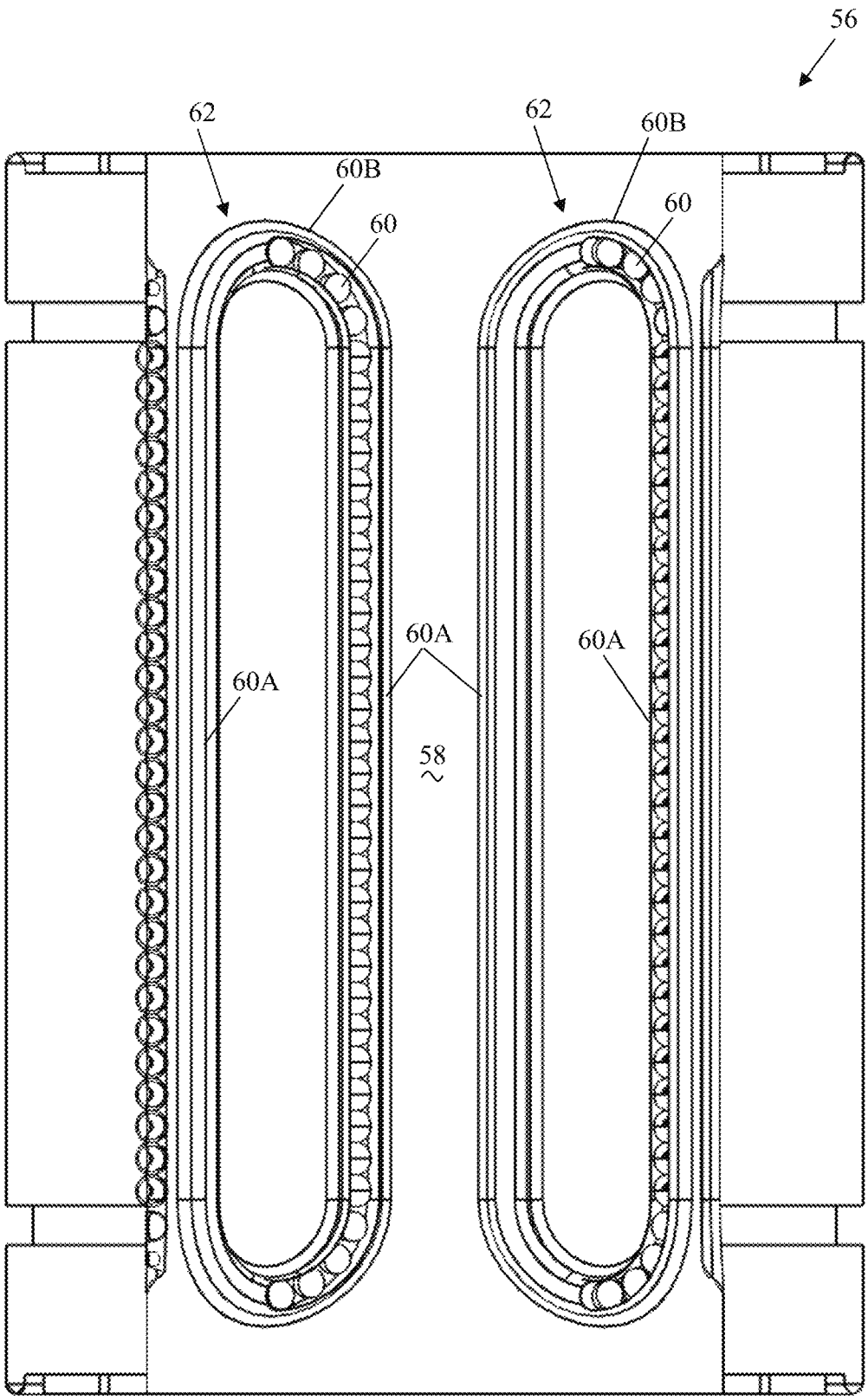
FIG. 9 is a cross-section of the slide bearing taken though line 9-9 of FIG. 8.
Figure 17:
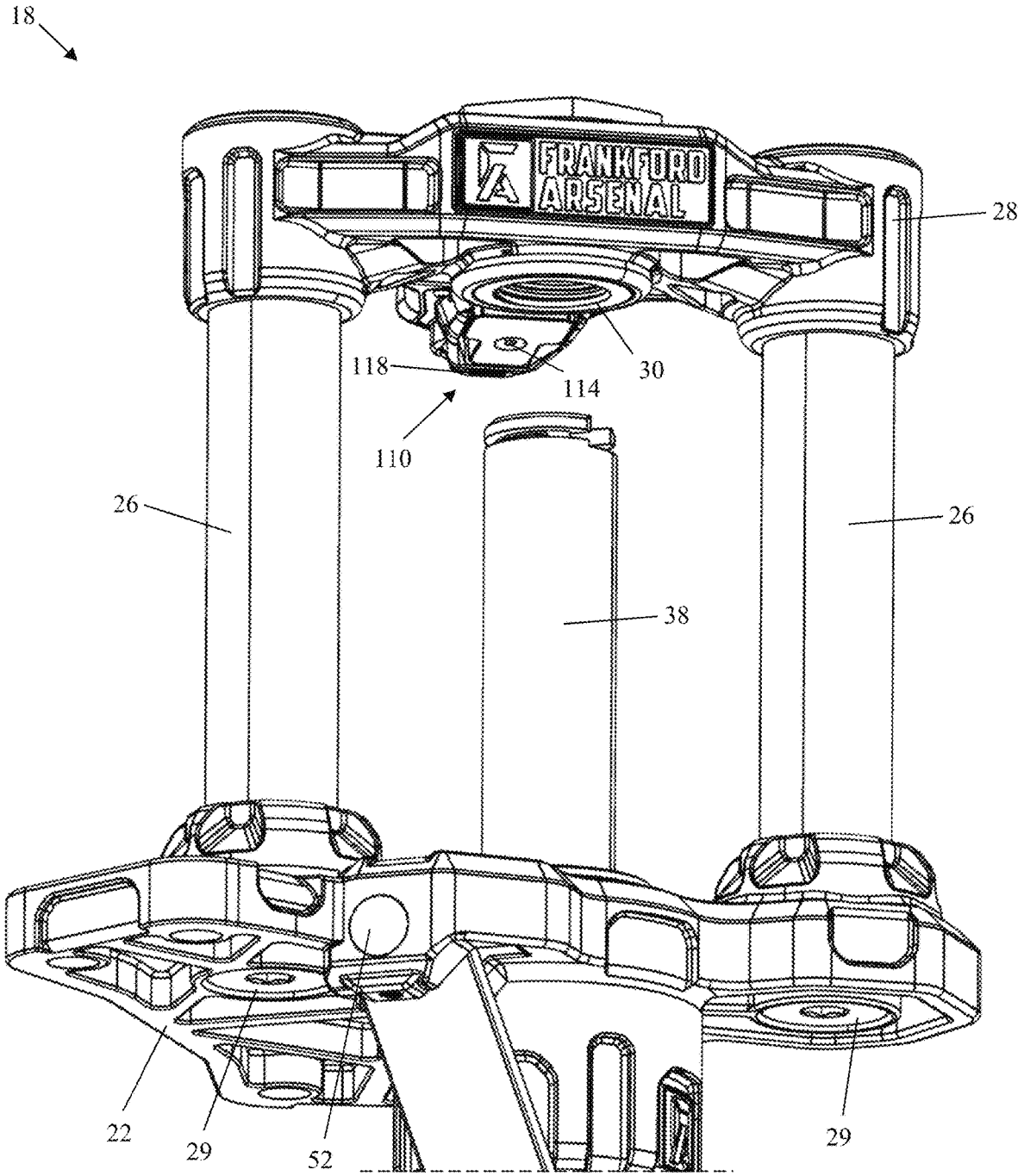
FIG. 17 is an enlarged, fragmentary perspective of the ammunition press.
Figure 18:
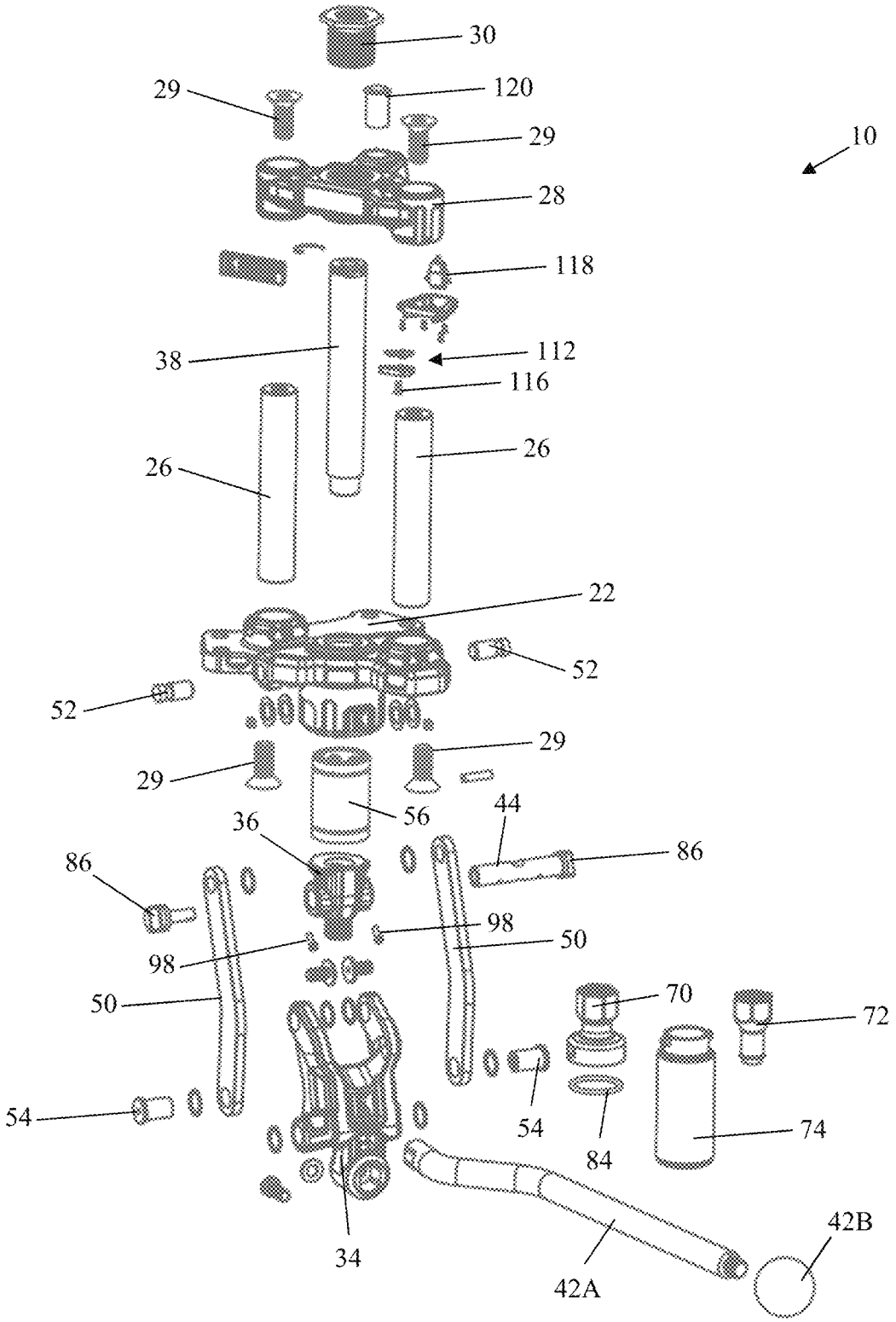
FIG. 18 is an exploded view of the ammunition press.

Referring to FIGS. 7 and 17, the ammunition press 10 includes a light assembly 110 provided on the head 28 of the frame 18 that can be used to illuminate the case holder 64. The light assembly 110 includes a light unit 112 comprising at least one LED 114 (broadly, "light emitting element" or "light source") and is secured to an underside of the head 28 by a fastener 116 (e.g., bolt, screw). The light assembly 110 includes a power port 118 (e.g., USB or micro USB port) for powering the light unit via a cord (not shown) plugged into a power outlet or other power supply (e.g., battery) and plugged into the power port. Alternatively, or in addition, the press could include a battery compartment (not shown) for housing a battery. The power port 118 is electrically connected by appropriate wiring (not shown) to a switch 120, which is electrically connected by appropriate wiring (not shown) to the light unit 112. In the illustrated embodiment, the switch 120 comprises a toggle push button 120A having an on position for powering the light unit 112 and an off position for turning the light unit off. A cavity 122 is provided in the head 28 of the frame 18 for receiving of the power port 118, the switch 120 and the light unit 112. Wiring is routed in a hidden manner within the cavity 122 between the power port 118, switch 120 and light unit 112. Accordingly, the light assembly 110 is integrated with the ammunition press 10. The light unit 112 is mounted to aim the LED 114 forward at an angle to illuminate the case holder 64. Other configurations of the light assembly can be used, and the light assembly can be omitted, without departing from the scope of the present disclosure.

It will be apparent that modifications and variations are possible without departing from the scope of the disclosure defined in the appended claims. For example, the press could be configured such that the case holder remains stationary while the die holder is moved by the driver toward the case holder. In such a configuration, the driver may have an arrangement as shown herein but the location of the die holder on the frame and the case holder on the ram may be swapped. Alternatively, the driver could be configured to move an upper die holder downward to a stationary lower case holder. Moreover, the die holder and the case holder may move toward each other.

As various changes could be made in the above constructions and methods without departing from the scope of the disclosure, it is intended that all matter contained in the above description and shown in the accompanying drawings shall be interpreted as illustrative and not in a limiting sense.

What is claimed is:

1. An ammunition press comprising:

a frame having a base, the base configured to engage a support surface to support the ammunition press on the support surface;

a die holder supported by the frame and configured to hold a die for performing an operation on an ammunition case;

a driver supported by the frame and movable with respect to the frame to engage an ammunition case with the die, the driver including a ram, a linkage, and a lever, the ram being movable between a home position and a pressing position for engaging the ammunition case with a die on the die holder, the lever being pivotable with respect to the frame in an actuating direction from a non-actuated position, the linkage being connected to the lever such that pivoting of the lever in the actuating direction moves the ram toward the pressing position; and a stop having an engagement surface, the stop being arrangeable in a first arrangement and a second arrangement, wherein in the first arrangement the engagement surface is arranged to engage the driver to set the lever in a first actuated position in which the lever is prevented from further pivoting in the actuating direction, the engagement surface facing a first direction when the stop is in the first arrangement, and wherein in the second arrangement the stop is arranged to engage the driver to set the lever in a second actuated position, different from the first actuated position, in which the lever is prevented from further pivoting in the actuating direction, the engagement surface facing a second direction, different from the first direction, when the stop is in the second arrangement.

2. The ammunition press of claim 1, wherein the first actuated position is farther in the actuating direction than the second actuated position.

3. The ammunition press of claim 2, wherein the stop is configured to be rotated between the first and second arrangements.

4. The ammunition press of claim 3, wherein the stop is configured to be rotated about 180 degrees between the first and second arrangements.

5. The ammunition press of claim 2, wherein the stop includes a recess, the recess arranged to receive the driver when the stop is in the first arrangement.

6. The ammunition press of claim 5, wherein the engagement surface defines the recess, the engagement surface configured to engage the driver when the stop is in the first arrangement.

7. The ammunition press of claim 6, wherein the stop includes a second engagement surface opposite the first engagement surface, the second engagement surface configured to engage the driver when the stop is in the second arrangement.

8. The ammunition press of claim 1, wherein the stop is carried by the driver and configured to move with the driver with respect to the frame when the lever is moved in the actuating direction to move the ram toward the pressing position.

9. The ammunition press of claim 8, wherein a pivot axis between the linkage and the ram extends through the stop.

10. The ammunition press of claim 1, wherein the engagement surface, in the first arrangement, is arranged to engage the linkage of the driver to set the first actuated position of the lever.

11. The ammunition press of claim 1, wherein the linkage includes a linkage arm pivotably connected to the base, the engagement surface, in the first arrangement, being arranged to engage the linkage arm to set the first actuated position of the lever.

12. An ammunition press comprising:

a frame having a base, the base configured to engage a support surface to support the ammunition press on the support surface;

a die holder supported by the frame and configured to hold a die for performing an operation on an ammunition case;

a driver supported by the frame and movable with respect to the frame to engage an ammunition case with the die, the driver including a ram, a linkage, and a lever, the ram being movable between a home position and a pressing position for engaging the ammunition case with a die on the die holder, the lever being pivotable with respect to the frame in an actuating direction from a non-actuated position to an actuated position in which the lever is prevented from pivoting farther in the actuating direction, the linkage being connected to the lever such that pivoting of the lever in the actuating direction toward the actuated position moves the ram toward the pressing position; and a stop carried by the driver and configured to move with the driver with respect to the frame when the lever is moved in the actuating direction to move the ram toward the pressing position, the stop arranged to engage the driver to set the actuated position of the lever, the stop being adjustable to change the actuated position of the lever in which the lever is prevented from pivoting farther in the actuating direction.

13. The ammunition press of claim 12, wherein the stop is arrangeable in a first configuration where the stop is arranged to engage the driver to set the lever in a first actuated position in which the lever is prevented from further pivoting in the actuating direction and a second configuration where the stop is arranged to engage the driver to set the lever in a second actuated position, different from the first actuated position, in which the lever is prevented from further pivoting in the actuating direction.

14. The ammunition press of claim 13, wherein the stop is configured to be rotated between the first and second configurations.

15. The ammunition press of claim 14, wherein the stop is configured to be rotated about 180 degrees between the first and second configurations.

16. The ammunition press of claim 13, wherein the stop includes a recess, the recess arranged to receive the driver when the stop is in the first configuration.

17. The ammunition press of claim 16, wherein the stop includes a first engagement surface defining the recess, the first engagement surface configured to engage the driver when the stop is in the first configuration.

18. The ammunition press of claim 17, wherein the stop includes a second engagement surface opposite the first engagement surface, the second engagement surface configured to engage the driver when the stop is in the second configuration.

19. The ammunition press of claim 12, wherein a pivot axis between the linkage and the ram extends through the stop.

20. The ammunition press of claim 12, wherein the stop is arranged to engage the linkage of the driver to set the actuated position of the lever.

21. The ammunition press of claim 12, wherein the linkage includes a linkage arm pivotably connected to the base, the stop being arranged to engage the linkage arm to set the actuated position of the lever.

* * * * *